US007244089B2

(12) United States Patent
Sperling

(10) Patent No.: US 7,244,089 B2
(45) Date of Patent: Jul. 17, 2007

(54) DEVICE FOR REMOVING METALLIC OBJECTS FROM A RAILWAY BED

(75) Inventor: Fred S. Sperling, Canton, OH (US)

(73) Assignee: Sperling Railway Services, Inc., Canton, OH (US)

( * ) Notice: Subject to any disclaimer, the term of this patent is extended or adjusted under 35 U.S.C. 154(b) by 213 days.

(21) Appl. No.: 10/889,920

(22) Filed: Jul. 13, 2004

(65) Prior Publication Data

US 2006/0045684 A1 Mar. 2, 2006

(51) Int. Cl.
*B61F 19/00* (2006.01)

(52) U.S. Cl. ..... 414/434; 104/279; 198/510.1

(58) Field of Classification Search ..... 414/434, 414/505; 198/510, 510.1; 104/279–280
See application file for complete search history.

(56) References Cited

U.S. PATENT DOCUMENTS 3,690,264 A * 9/1972 Plasser et al. ..... 104/17.1
3,731,455 A * 5/1973 Theurer ..... 53/391
3,822,778 A * 7/1974 Coats ..... 198/567
4,178,236 A * 12/1979 Theurer ..... 209/215
4,178,237 A * 12/1979 Theurer ..... 209/215
4,225,429 A * 9/1980 Holley ..... 209/215
4,263,797 A * 4/1981 Cooper ..... 72/40
4,478,152 A * 10/1984 Holley ..... 104/279
4,662,505 A * 5/1987 Bunney ..... 198/443
4,722,283 A * 2/1988 Holley ..... 104/279
4,940,001 A * 7/1990 Holley ..... 104/307

* cited by examiner

*Primary Examiner*—Patrick Mackey
*Assistant Examiner*—Charles Greenhut
(74) *Attorney, Agent, or Firm*—Sand & Sebolt

(57) ABSTRACT

A machine which travels on railroad rails includes a conveyor belt which transports metallic objects from a railway bed into a hopper. The conveyor belt revolves around a pair of rollers mounted on the framework of a conveyor belt assembly. One roller magnetically picks up the metallic objects and a hydraulic motor powers the other roller to drive the conveyor belt. The magnetized roller is mounted via two mounting bearings which slidably engage the assembly. An adjustment bolt on the assembly engages the mounting bearing to move the magnetized roller to adjust conveyor belt tension to facilitate replacement of the belt. A lift beside the assembly raises and lowers one end of the assembly which rotates about a pivot tube within the conveyor belt. The lift, pivot tube and hydraulic lines connected to the motor are all situated to allow the belt to be removed without interference therefrom.

33 Claims, 17 Drawing Sheets

| FIG-2A | FIG-2B |
|---|---|

DEVICE FOR REMOVING METALLIC OBJECTS FROM A RAILWAY BED

BACKGROUND OF THE INVENTION

1. Technical Field

The present invention relates to a device which travels on railroad track rails and removes metallic objects, such as railroad spikes, from a railway bed. More particularly, the invention relates to such a device which has a conveyor belt for transporting the metallic objects from adjacent the railway bed into containers. Specifically, the invention relates to such a device which is configured to facilitate removal of worn conveyor belts and installation of new conveyor belts.

2. Background Information

In the railway industry, railroad track is constantly being repaired or replaced. One result of this work is the accumulation of metallic objects such as railroad spikes along the railway bed. Due to the large number of spikes and other metallic objects used, the railway bed which repair workers traverse daily may easily be littered with thousands of used spikes and other metallic objects which need to be removed. Cars or retrievers which ride on railroad track rails have been developed to facilitate the removal of these spikes and other metallic objects. The metallic objects are picked up magnetically and carried on a conveyor belt to hoppers on the car for transport to a location where they can be removed from the hoppers and recycled as scrap metal or otherwise.

One problem arising with the use of these cars is the replacement of the conveyor belts, which experience a substantial amount of wear. Typically, these conveyor belts are made of a reinforced elastomeric material which forms a loop. The replacement of the conveyor belts has been a tedious and time-consuming task. One solution involves the use of laced belts, which, however, present accelerated wear problems.

A laced belt has an elongated strip of the elastomeric material with a set of metal interlocking teeth on either end thereof so that the teeth of one set are laced together with the teeth of the other set to form the loop of the conveyor belt. To replace these belts, the two sets of teeth are disengaged from one another so that the belt may be slipped out along the length the conveyor belt track. While the laced-belt solution facilitates removal and replacement, the accelerated wear problem noted above arises due to the joint between the elastomeric material and the metal teeth, which naturally creates a point of wear as the conveyor belt moves about its track.

Thus, a continuous-loop belt of reinforced elastomeric material is preferred over the lace belts because they are longer lasting. However, the continuous-loop belts must still be replaced on a regular basis and expediting this replacement eliminates substantial down time of these metal-collecting cars. The problem arising is that the continuous-loop belts must be moved laterally, that is, transverse to their length, in order to remove a worn belt from its track and install a new belt on the track. This movement has been particularly difficult because the conveyor belt assembly and various other structure interferes with this lateral movement.

For example, the prior art uses a lift (or lifts) for adjusting the height of one end of the conveyor belt. The lift either spans the conveyor belt from side to side or is otherwise situated on the removal side of the conveyor belt so that the lift or a portion thereof must be removed from the conveyor belt assembly or other supporting structure to permit removal or installation of a belt. Another interfering factor is the structure about which the conveyor belt assembly pivots in order for the above-noted lift to raise one end of the conveyor belt assembly. The prior art pivot structure is disposed external to the loop of the conveyor belt at the exit end of the belt, which is adjacent the hopper into which metal objects are conveyed. As such, the pivot structure also spans the conveyor belt and is attached to both sides of the belt assembly so as to prevent removal and installation of a belt absent removal of the pivot structure from the belt assembly. Further, these conveyor belts are typically driven by a motorized roller disposed within the conveyor belt loop and in frictional engagement with the belt. The motor driving this drive roller is typically hydraulic and so requires hydraulic pressure and return lines between the motor and a hydraulic pump. The prior art hydraulic lines are also situated external to the conveyor belt loop so that they too interfere with removal and installation of the belt unless the lines are disconnected. The present invention provides a solution to these problems and greatly simplifies conveyor belt removal and installation.

BRIEF SUMMARY OF THE INVENTION

The present invention provides an apparatus for removing metallic objects from a railway bed having rails, the apparatus comprising a car adapted to travel on the rails; a container mounted on the car; at least one conveyor belt forming a closed loop; the at least one conveyor belt adapted to transport the metallic objects from adjacent the railway bed to the container; at least one conveyor belt assembly on which the at least one conveyor belt is revolvably mounted; the at least one conveyor belt assembly having first and second opposed ends and first and second opposed sides each extending between the first and second ends; and a lift for moving the first end of the at least one conveyor belt assembly between a raised position and a lowered position adjacent the railway bed; the lift being disposed on the first side of the at least one conveyor belt assembly whereby the lift does not interfere with removal of the at least one conveyor belt from the second side of the at least one conveyor belt assembly; the at least one conveyor belt being removable while maintaining continuity of the at least one conveyor belt loop.

The invention further provides an apparatus for removing metallic objects from a railway bed having rails, the apparatus comprising a car adapted to travel on the rails; a container mounted on the car; at least one conveyor belt forming a closed loop and being adapted to transport the metallic objects from adjacent the railway bed to the container; at least one conveyor belt assembly on which the at least one conveyor belt is revolvably mounted; and a motor for revolvingly driving the at least one conveyor belt on the at least one conveyor belt assembly; the motor being in communication with power connections which pass within the loop of the at least one conveyor belt to prevent interference with removal of the at least one conveyor belt from the at least one assembly; the at least one conveyor belt being removable while maintaining continuity of the at least one conveyor belt loop.

DETAILED DESCRIPTION OF THE INVENTION

Figures 1, 2:
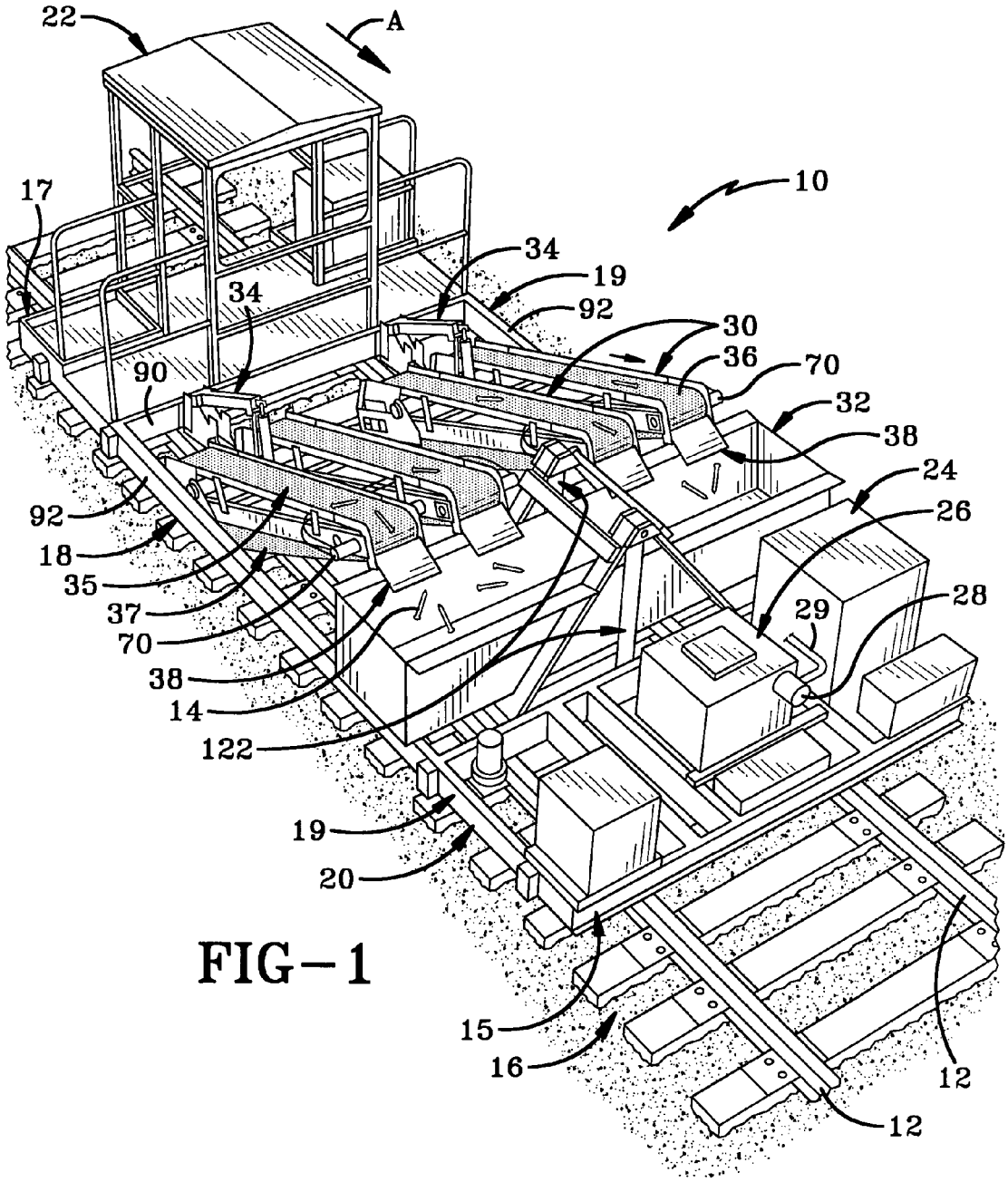
FIG. 1 is a perspective view of the device for moving metallic objects from a railway bed of the present invention.
FIG. 2 is a schematic view showing the relative positions of FIGS. 2A and 2B which together show a top plan view of the conveyor belt assembly and related apparatus.

The retriever or the device of the present invention is shown generally at 10 in FIG. 1. Retriever 10 is configured to travel along a pair of spaced rails 12 of a railroad track in the direction of Arrow A in FIG. 1 and remove metallic objects such as railroad spikes 14 from a railway bed 16. Retriever 10 includes a car 18 having a frame 20. Car 18 has a front end 15, a rear end 17 and a pair of opposed sides 19 each extending from front end 15 to rear end 17. Frame 20 includes a pair of longitudinal side frame members or side rails 92 extending along respective sides 19 of car 18. A cabin 22 from which retriever 10 may be driven is mounted on frame 20. An engine 24 is mounted on frame 20 to power retriever 10 for travel on railroad rails 12. A hydraulic reservoir 26 and hydraulic pump 28 are also mounted on frame 20 to provide hydraulic power to various mechanisms on retriever 10 via hydraulic lines. Retriever 10 includes four conveyor belt assemblies 30 for picking up and transferring spikes 14 or other metallic objects from railway bed 16 into a hopper 32. The four conveyor belt assemblies are divided into two pairs each of which forms an associated set which is associated with a respective lift 34. A conveyor belt 36 is associated with each conveyor belt assembly 30 and is in the form of a loop which revolves on a respective conveyor belt assembly 30. Conveyor belt 36 includes an upper portion 35 and a lower portion 37 defining respectively the upper and lower bounds of the conveyor belt loop. A rotatably mounted ramp assembly 38 is also associated with each conveyor belt assembly 30 and functions to guide spikes 14 from respective conveyor belts 36 into hopper 32.

Figure 2A:
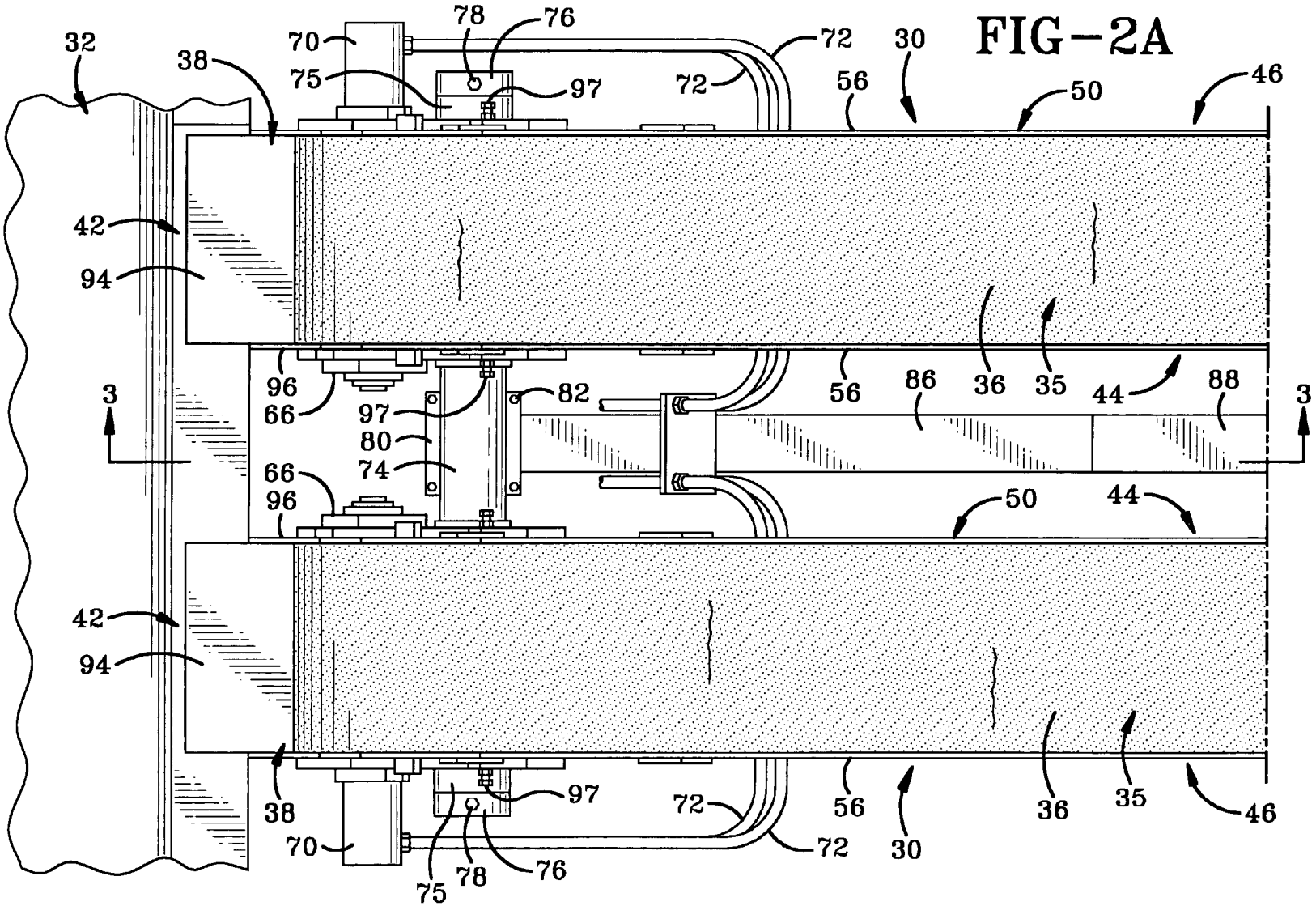
FIG. 2A is a fragmentary top plan view of the upper portion of the conveyor belt assembly.
Figure 2B:
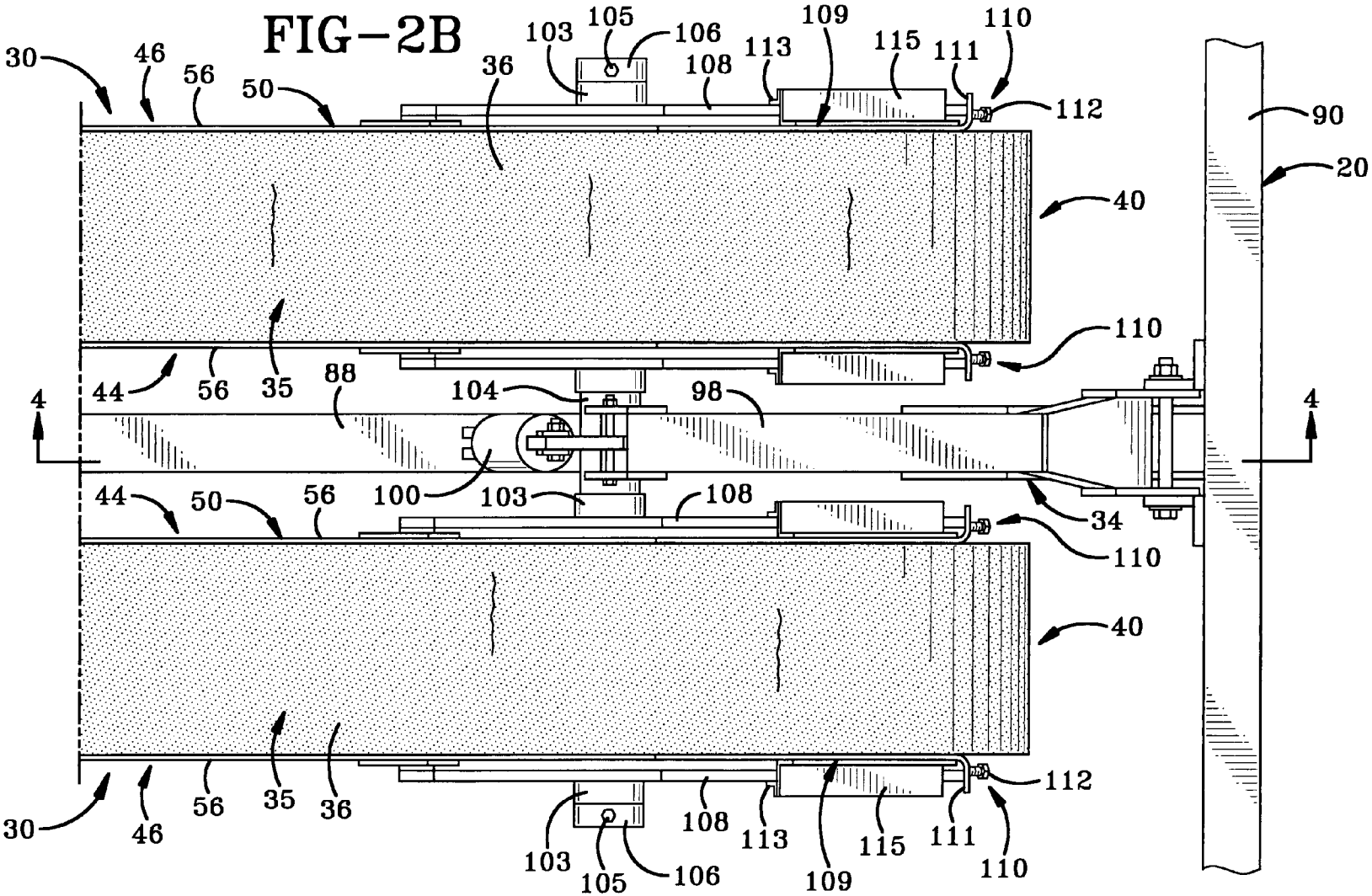
FIG. 2B is a fragmentary top plan view of the lower portion of the conveyor belt assembly.

With reference to FIGS. 2A-4, conveyor belt assemblies 30, lift 34 and ramp assembly 38 are further detailed. FIGS. 2A and 2B show one of the sets of conveyor belt assemblies 30, the set including a pair of conveyor belt assemblies, one inboard and one outboard. The other set of conveyor belt assemblies 30 is either identical or a mirror image of that shown in FIGS. 2A and 2B, and thus only one set will be described, except as otherwise noted herein. Each conveyor belt assembly 30 has a first end 40 and a second end 42 opposed to first end 40. Each conveyor belt assembly 30 also has a first side 44 and a second side 46 in an opposed relation to first side 44, each side extending between first end 40 and second end 42 of assembly 30. The respective first sides 44 of the assemblies 30 within a given set face one another and are spaced from one another a distance greater than the width of one of railroad rails 12. Each assembly 30 is substantially parallel to the other assemblies 30 and is situated so that sides 44 and 46 thereof are substantially parallel to side rails 92 of frame 20 and thus generally aligned with railroad rails 12 (FIG. 1). Lift 34 is disposed between the two conveyor belt assemblies 30 of each set of said assemblies and is configured to raise and lower first end 40 of each conveyor belt assembly 30, as further detailed below. The second side 46 of each outboard assembly 30 is disposed adjacent a respective side rail 92 and a respective side 19 of car 18, thus facing generally outwardly with respect to car 18 (FIG. 1). The respective second sides 46 of the inboard assemblies 30 face one another and face generally inwardly with respect to car 18 (FIG. 1).

Figure 3:
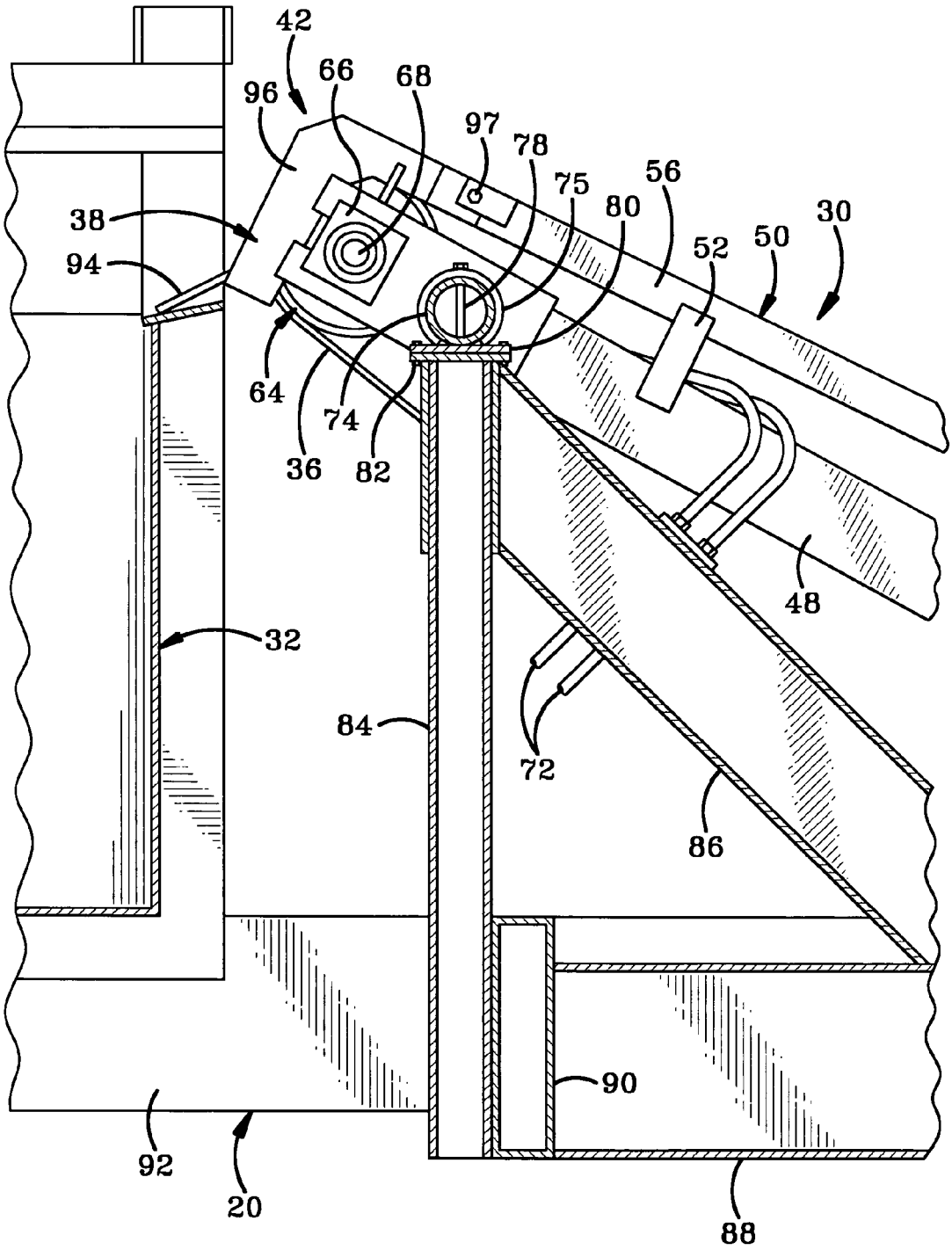
FIG. 3 is a sectional view taken along line 3-3 of FIG. 2A.
Figure 4:
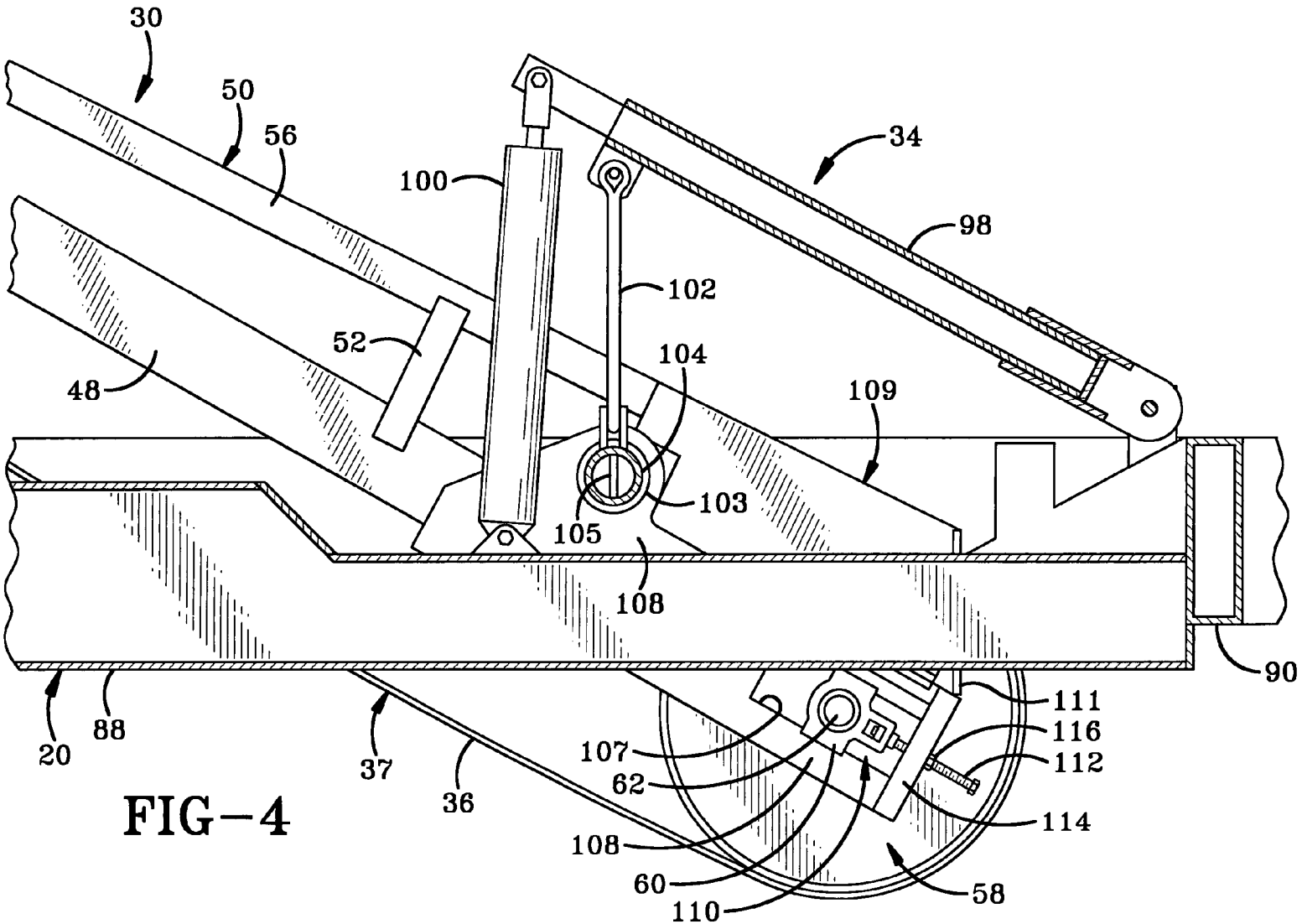
FIG. 4 is a sectional view taken along line 4-4 of FIG. 2B.
Figure 5:
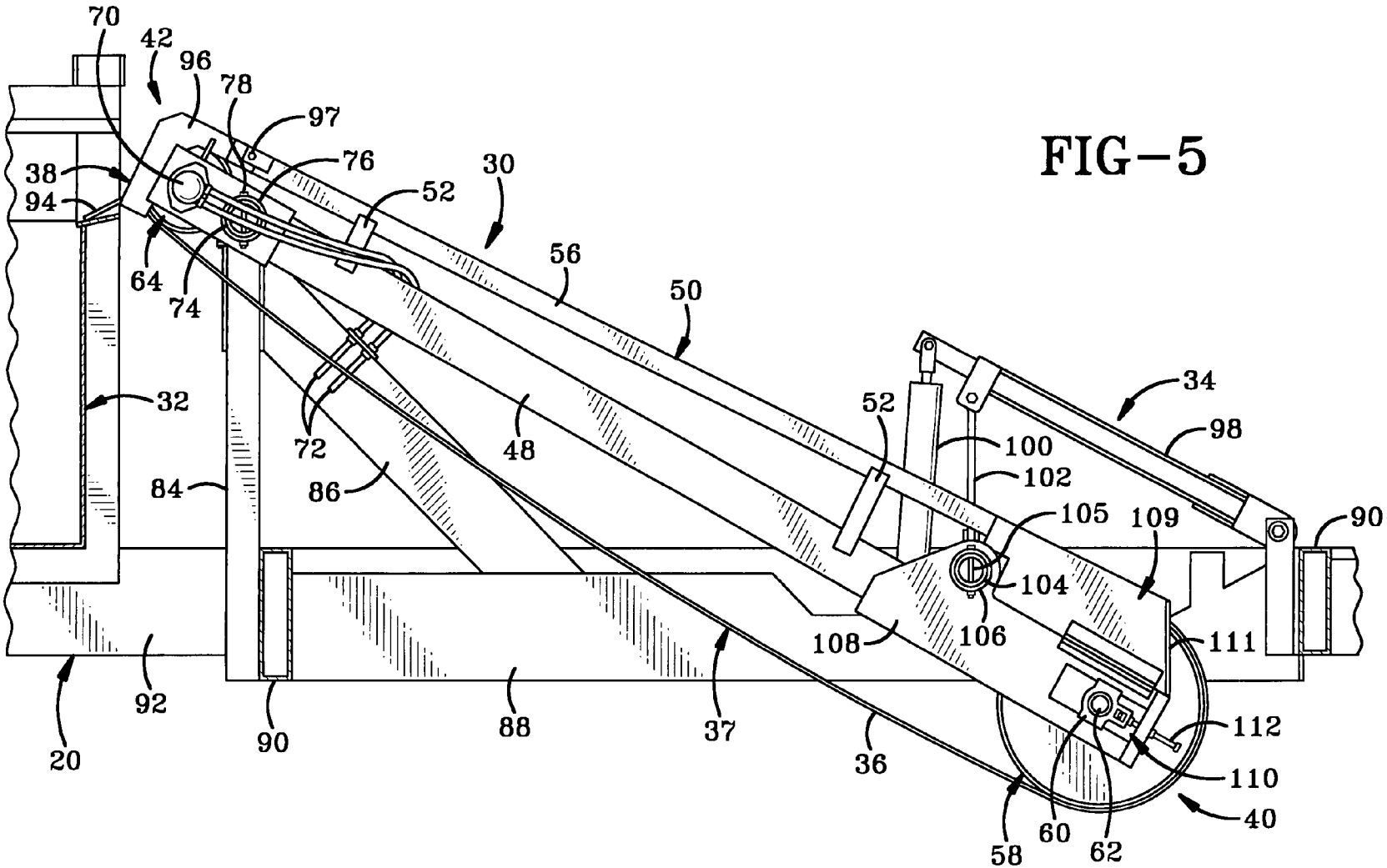
FIG. 5 is a fragmentary side elevational view of the conveyor belt assembly in a lowered operational position.
Figure 12:
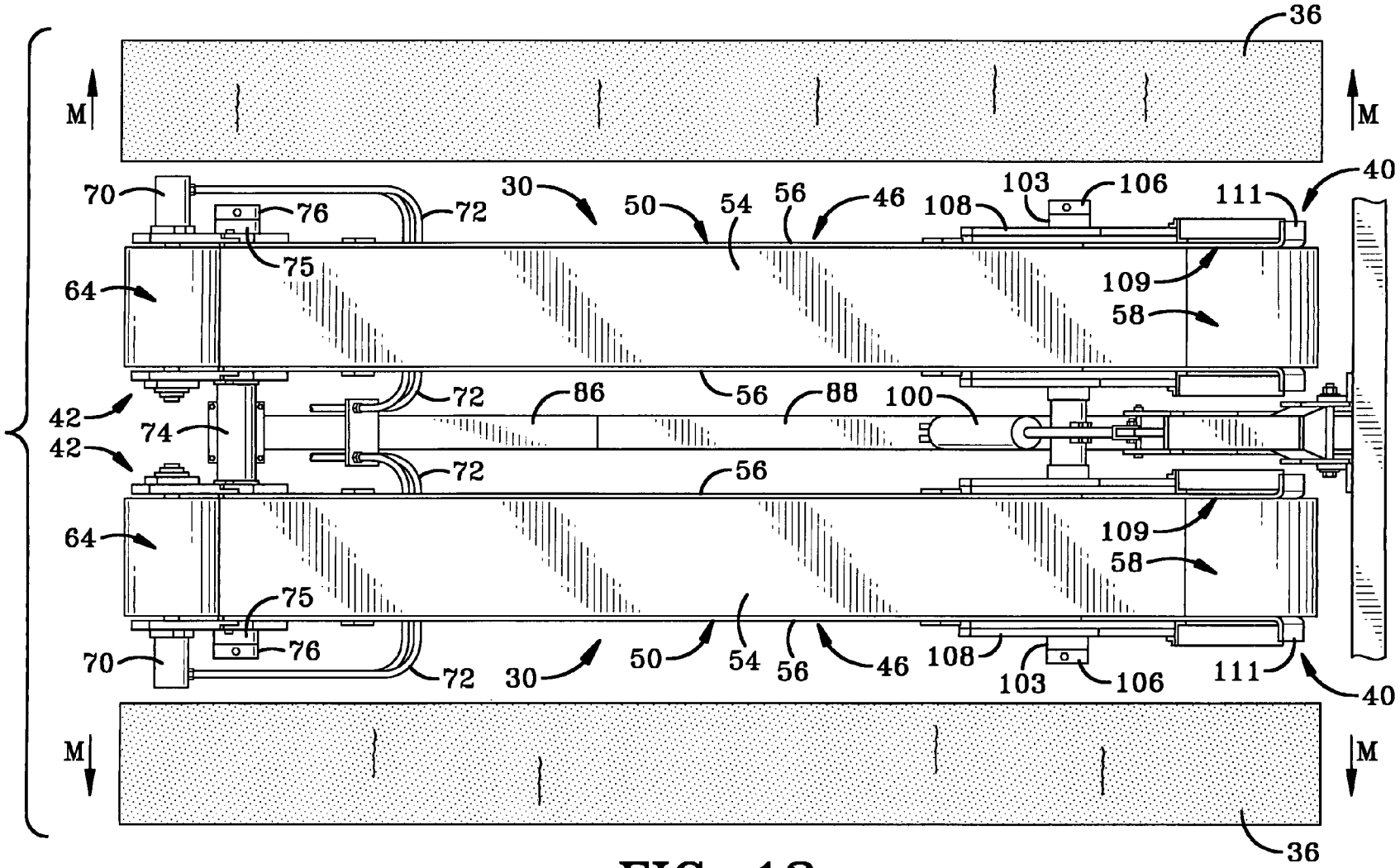
FIG. 12 is a fragmentary top plan view of the conveyor belt assembly showing the conveyor belt having been removed.
Figure 13:
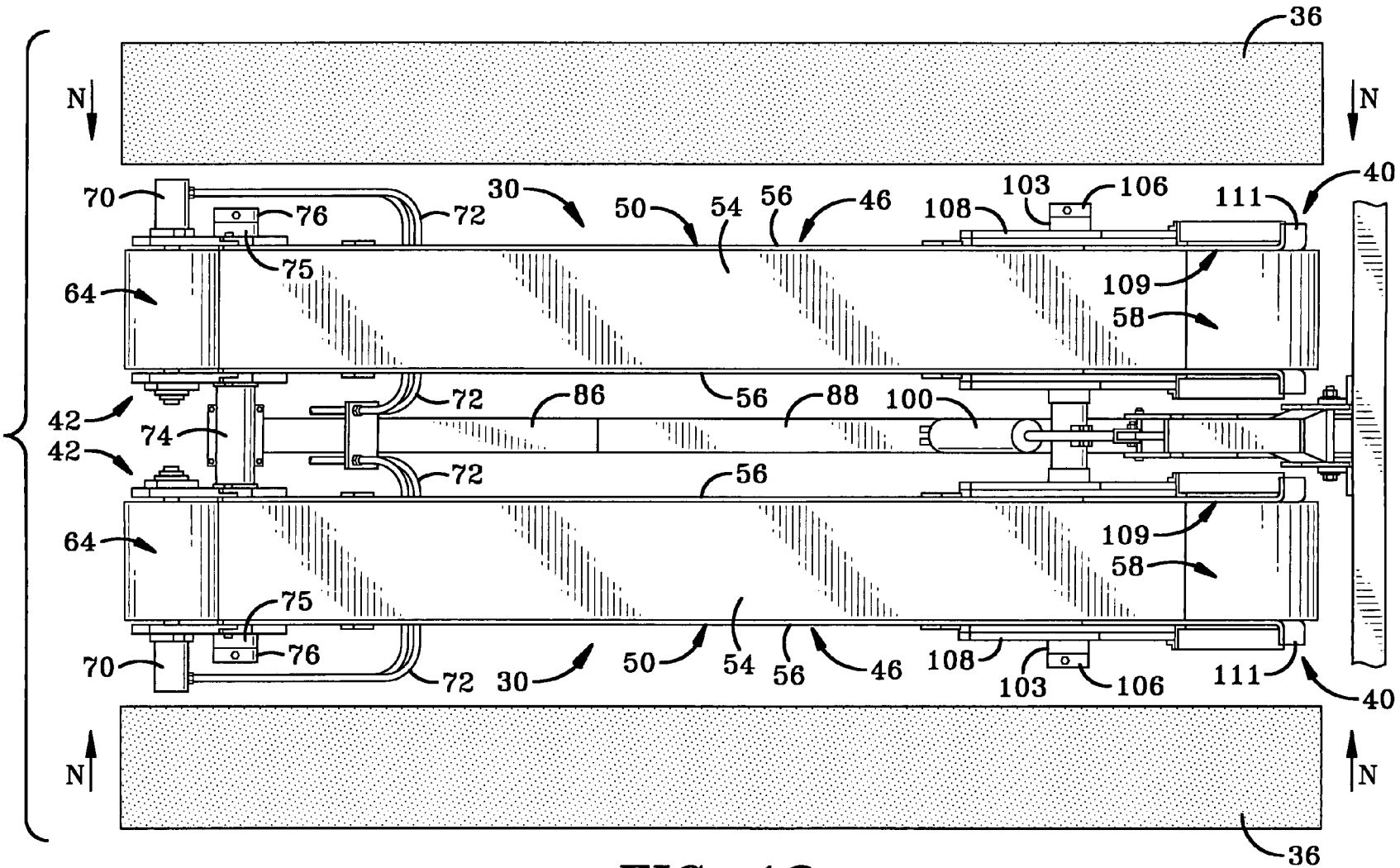
FIG. 13 is similar to FIG. 12 except showing the conveyor belts in the process of being installed.

With reference to FIGS. 3-4, each conveyor belt assembly 30 includes an elongated frame member 48 extending between first end 40 and second end 42. A track 50 is disposed upwardly of frame member 48 and is mounted thereon by mounting members 52. Track 50 includes a flat elongated bed 54 (FIG. 12) and a pair of opposed guide walls 56 extending upwardly therefrom along respective sides 44 and 46. With reference to FIG. 4, a first cylindrical roller 58 is rotatably mounted on frame member 48 via a mounting member in the form of a mounting bearing 60, which rotatably receives a central shaft 62 attached to first roller 58. With reference to FIG. 3, a second roller 64 is rotatably mounted to frame member 48 adjacent second end 42 of assembly 30 via a mounting member 66 which rotatably receives a shaft 68 attached to second roller 64. Second roller 64 is a drive roller and is powered to rotate and thus drive conveyor belt 36 to revolve around first roller 58 and second roller 64. With reference to FIG. 2A, second roller 64 is powered by a hydraulic motor 70 via hydraulic pressure and return lines 72 which are in communication with hydraulic pump 28 (FIG. 1) via hydraulic lines 29. In accordance with one of the main features of the present invention, hydraulic lines 72 pass through the loop formed by conveyor belt 36 (FIGS. 2A, 3 and 5). More particularly, lines 72 pass between upper portion 35 and lower portion 37 of belt 36 beneath track 50 and between first and second rollers 58 and 64.

With reference to FIGS. 2A and 3, frame member 48 of conveyor belt assembly 30 is rotatably mounted on a cylindrical pivot tube 74 via cylindrical sleeve 75, which is mounted to and extends through frame member 48. A removable retaining ring 76 encircles pivot tube 74 adjacent an end thereof to selectively retain sleeve 75 from sliding off of pivot tube 74 and thus selectively retain second end 42 of conveyor belt assembly 30. In particular, a removable bolt 78 extends through respective aligned holes (not shown) in pivot tube 74 and retaining ring 76 whereby ring 76 is selectively removable. Pivot tube 74 is mounted to frame 20 of car 18 via a mounting plate 80 and a plurality of bolts 82. More particularly, with reference to FIG. 3, frame 20 includes an upright 84 to which mounting plate 80 is mounted. Frame 20 also includes an inclined support 86 attached to upright 84 for stabilizing upright 84. Support 86 angles upwardly from a generally horizontal base member 88, which is mounted on a pair of transverse members 90 of frame 20. Transverse members 90 extend between longitudinal side rails 92 of frame 20 (FIGS. 1, 3 and 4). With reference to FIGS. 2A and 3, ramp assembly 38 includes a ramp 94 mounted on a pair of spaced mounting arms 96 which are removably rotatably mounted to guide walls 56 of track 50 via removable bolts 97.

In accordance with one of the main features of the present invention and with reference to FIGS. 2B and 4, lift 34 is mounted between the pair of conveyor belt assemblies 30 and thus is located on side 44 of each conveyor belt assembly 30. This location precludes interference with removal and installation of conveyor belt 36 from side 46 of assembly 30. Lift 34 includes a support arm 98 rotatably mounted to frame 20 adjacent one of transverse members 90. Lift 34 further includes a hydraulically powered piston-cylinder combination 100 which is rotatably mounted to support arm 98 and to base member 88. Lift 34 further includes a suspension member 102 in the form of a chain, cable or other suitable structure which is preferably flexible but which may be rigid. Suspension member 102 is mounted at its upper end to support arm 98 and at its lower end to a cylindrical pivot tube 104. Pivot tube 104 is rotatably received within a sleeve 103 which is mounted on frame member 48 of assembly 30 via a pair of spaced support plates 108. A removable retaining ring 106 encircles pivot tube 104 adjacent an end thereof to selectively retain sleeve 103 from sliding off of pivot tube 104 and thus selectively retain first end 40 of conveyor belt assembly 30. In particular, a removable bolt 105 extends through respective aligned holes (not shown) in pivot tube 104 and retaining ring 106 whereby ring 106 is selectively removable.

In accordance with another feature of the present invention, pivot tube 104 and sleeve 103 are aligned to extend through or within conveyor belt 36 so as to preclude interference with removal and installation of belt 36 from side 46 of assembly 30. More particularly, pivot tube 104 and sleeve pass between upper portion 35 and lower portion 37 of belt 36 beneath track 50 and between first and second rollers 58 and 64. Each support plate 108 defines a slide opening 107 therein. With reference to FIGS. 2B, 4, 8 and 9, a guide plate 109 extends upwardly from each support plate 108 and is aligned with a respective guide wall 56 of track 50. Guide plate 109 includes an outwardly extending flange 111. Guide plate 109 is mounted to support plate 108 via a pair of angle irons 113 and 115.

Figure 9:
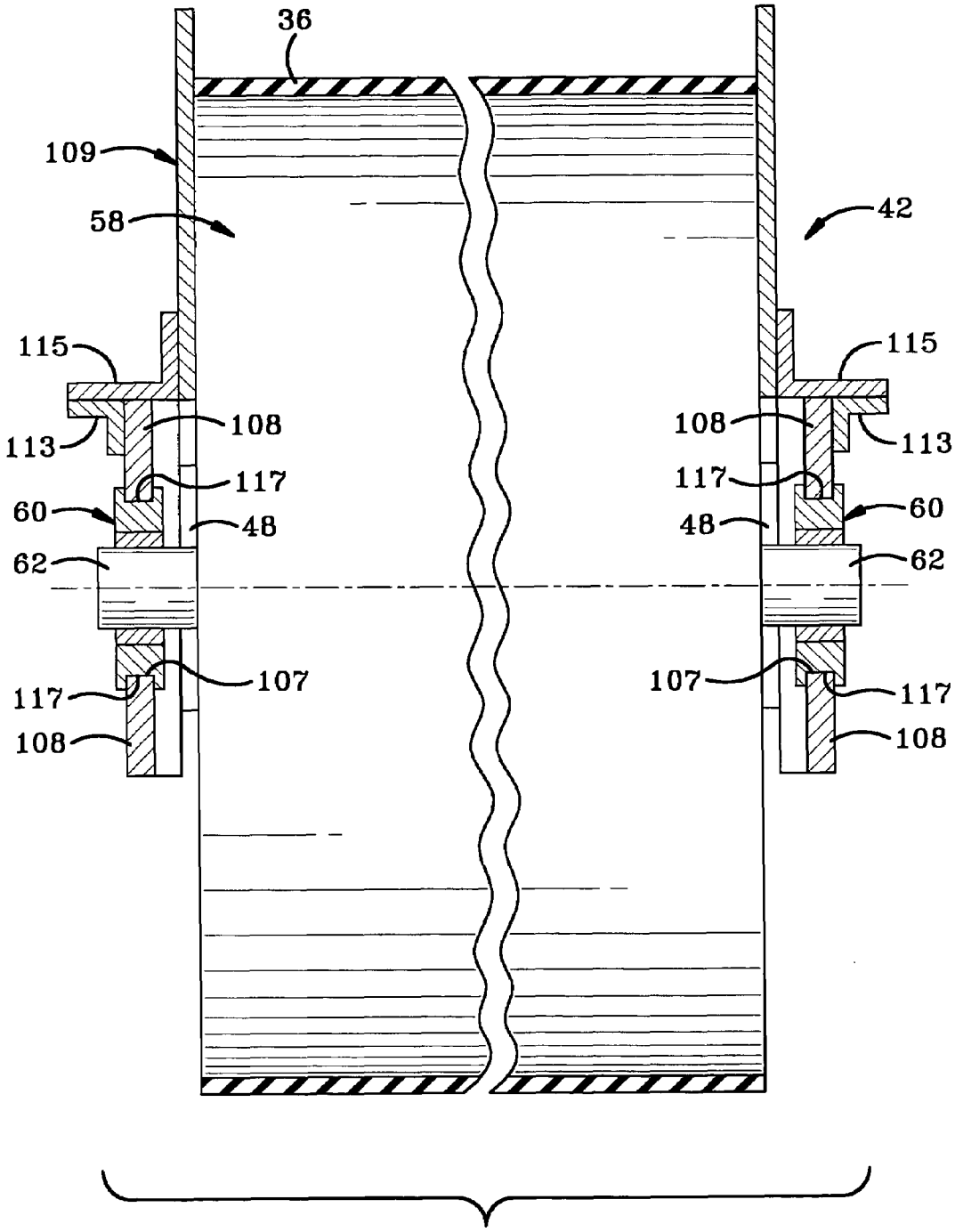
FIG. 9 is a sectional view taken on line 9-9 of FIG. 8.

With continued reference to FIGS. 2B and 4, conveyor belt assembly 30 includes a pair of adjustment mechanisms 110 for adjusting the tension of conveyor belt 36 to facilitate removal and installation respectively of worn and new conveyor belts 36. As seen in FIG. 2B, one of each pair of adjustment mechanisms 110 is disposed on first side 44 and the other disposed on second side 46 of assembly 30. Each adjustment mechanism 110 is identical or is a mirror image of the other and so only one will be described. With reference to FIG. 4, adjustment mechanism 110 includes a bolt 112 which threadably engages a transverse member 114 which is mounted on support plate 108 so as to bound one end of slide opening 107. A lock nut 116 also threadably engages bolt 112. Bolt 112 extends through a threaded hole (not shown) in transverse member 114 and is rotatably received by mounting bearing 60. With reference to FIG. 9, mounting bearing 60 defines a pair of outwardly facing opposed channels 117. Mounting bearing 60 is slidably received within slide opening 107 of support plate 108 with respective edges of support plate 108 which define opening 107 being slidably received within respective channels 117 of mounting bearing 60 in a tongue-in-groove engagement.

In operation and with reference to FIGS. 1 and 5-15, retriever 10 functions as follows. With reference to FIGS. 1 and 5, engine 24 is operated to drive retriever 10 on railroad rails 12 in the direction of Arrow A. Hydraulic pump 28 is operated to power hydraulic motor 70 in order to drive second roller 64 to drive conveyor belt 36 revolvingly about first roller 58 and second roller 64. First roller 58 contains magnets (not shown) which pick up railroad spikes 14 and other metallic objects from railway bed 16 and lift them onto the upper portion of conveyor belt 36 whereby spikes 14 are transported toward second end 42 of conveyor belt assembly 30. Spikes 14 then fall onto ramp 94 and into hopper 32.

With reference to FIGS. 5-15, the removal of a worn conveyor belt 36 and installation of a new conveyor belt 36 is described. FIG. 5 shows conveyor belt assembly 30 in a lowered operational position or mode wherein first roller 58 is in a lowered position adjacent railway bed 16 (FIG. 1). In this operational mode, first roller 58 is sufficiently close enough to railway bed 16 to magnetically pick up railroad spikes 14 and other metallic objects as retriever 10 travels along railroad rails 12. Each pair of conveyor belt assemblies 30 in each set thereof is spaced appropriately from one another to receive a respective one of railroad rails 12 between the respective first sides 44 adjacent respective first ends 40 thereof when in the lowered position. Thus, each outboard assembly 30 is disposed outwardly of the spaced railroad rails 12 and each inboard assembly 30 is disposed inwardly of its respective rails 12 or between rails 12. Each lift 34 is in a lowered position to support the respective set of conveyor belt assemblies 30 in the lowered operational mode. FIG. 5 also shows ramp assembly 38 in a downwardly rotated position with ramp 94 resting on a wall of hopper 32.

Figure 6:
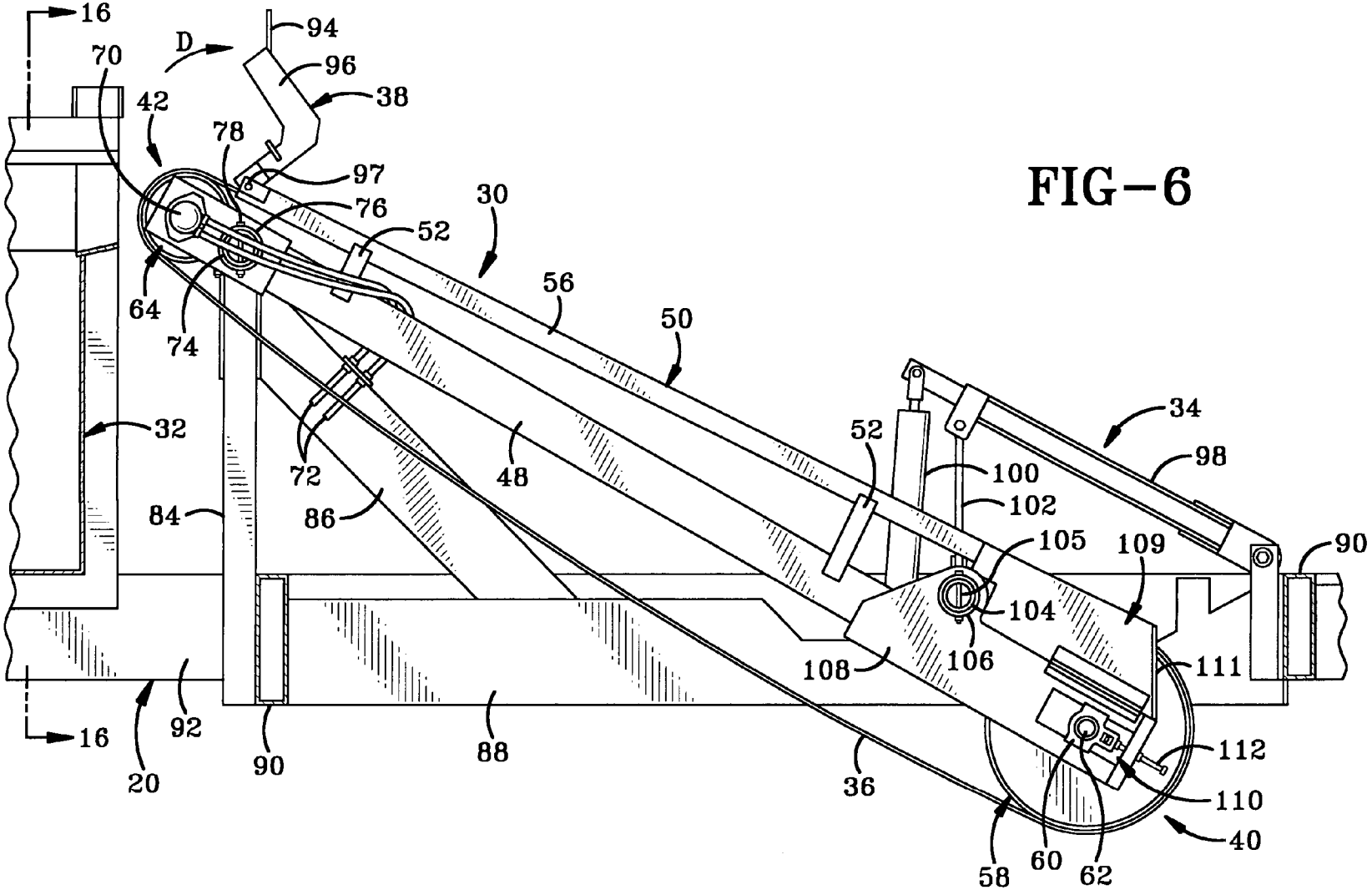
FIG. 6 is similar to FIG. 5 except it shows the ramp assembly rotated away from the hopper.

FIG. 6 shows ramp assembly 38 rotated in the direction of Arrow D about bolt 97. The ability of ramp assembly 38 to rotate is another feature of the invention, as detailed further below. FIG. 6 shows lift 34 still in the lowered position with piston-cylinder combination 100 in a retracted position.

Figure 7:
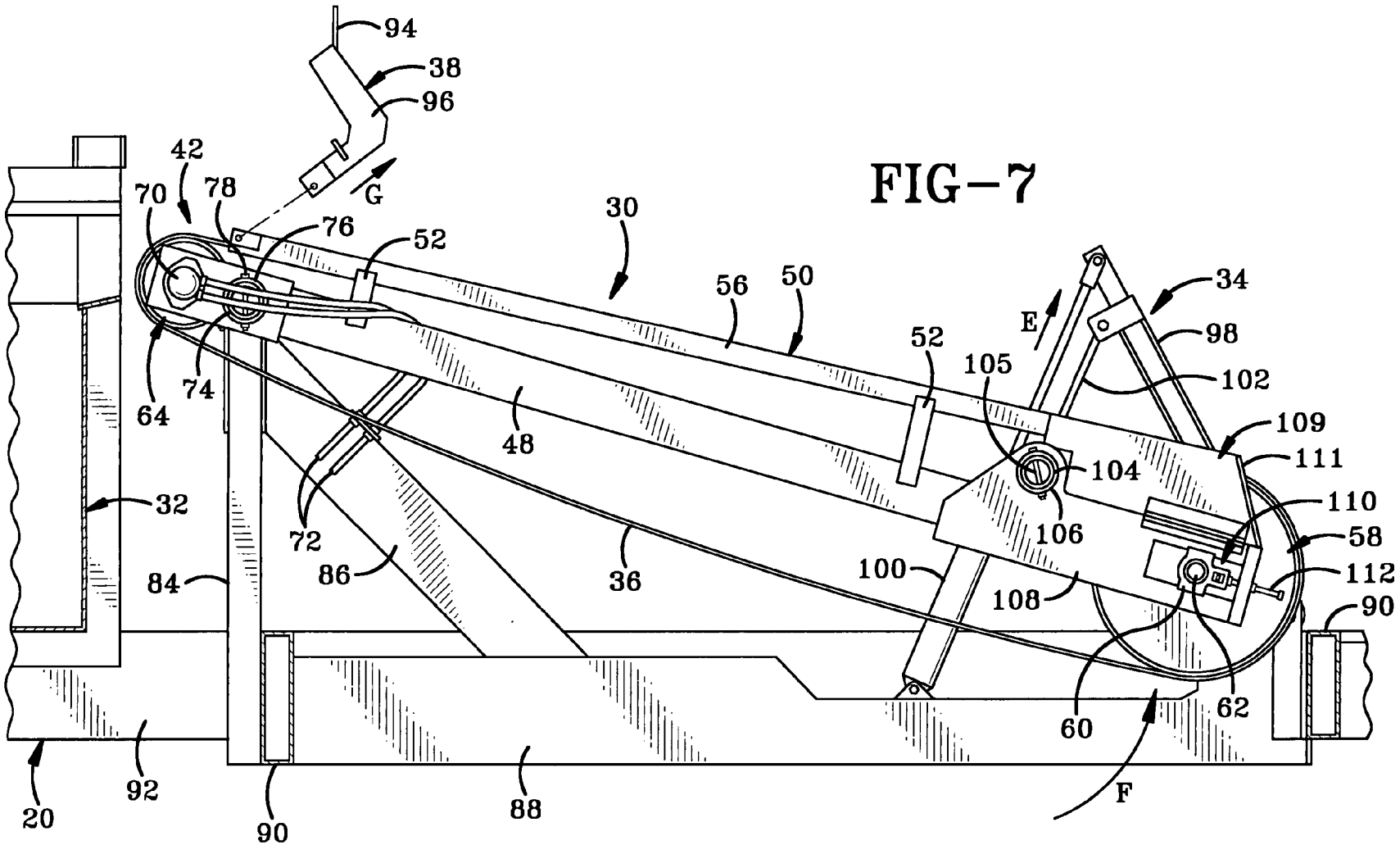
FIG. 7 is similar to FIG. 6 except it shows the conveyor belt assembly in a raised position with the ramp assembly removed.

FIG. 7 shows lift 34 having moved to a raised position. This is accomplished by operating hydraulic piston-cylinder combination 100 to move to an extended position as indicated by Arrow E. The raising of lift 34 is translated via suspension member 102 in order to lift pivot tube 104 and in turn the lower or first end 40 of carrier assembly 30. The raising of lift 34 and first end 40 of conveyor belt assembly 30 has caused conveyor belt 30 to rotate about pivot tubes 74 and 104 in the direction indicated by Arrow F. Conveyor belt 36 remains in a tightened position (as also shown in FIGS. 5 and 6). FIG. 7 also shows ramp assembly 38 being removed as indicated by Arrow G after bolts 97 have been sufficiently loosened or removed to allow this removal. The removal of ramp assembly 38 moves it out of the way so that it will not interfere with removal of conveyor belt 36 as further described below.

Figure 8:
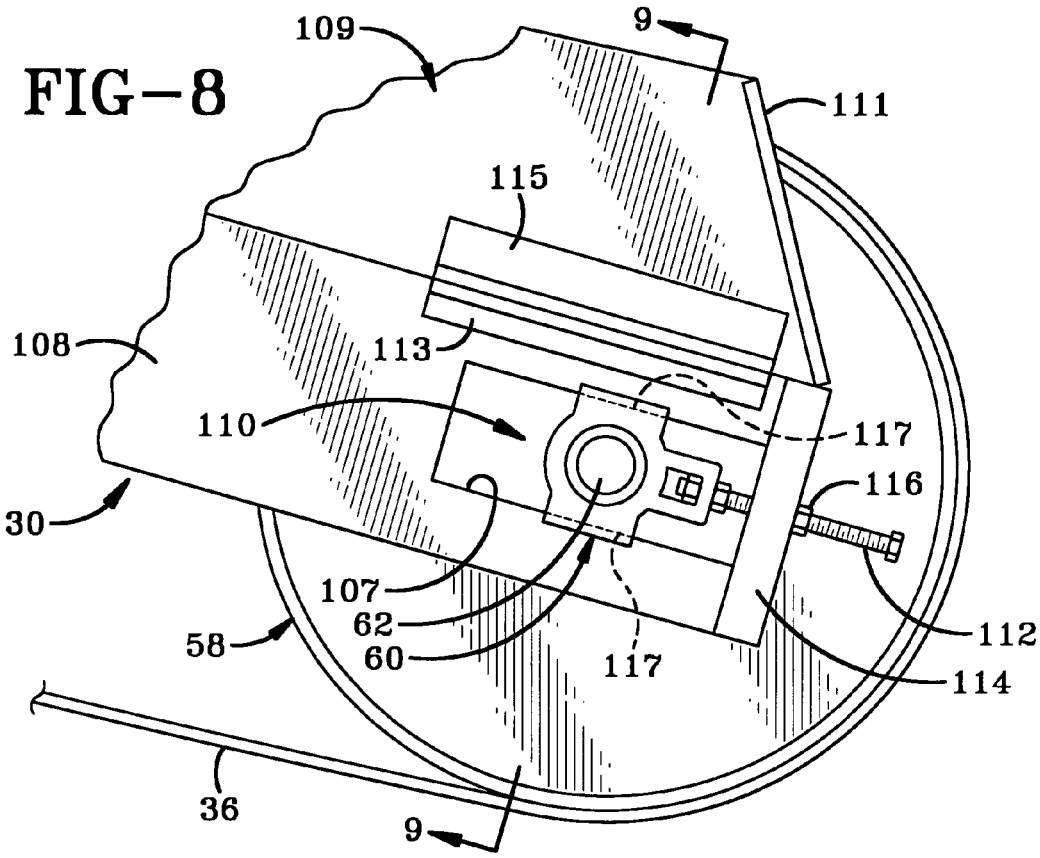
FIG. 8 is an enlarged fragmentary side elevational view of the magnetic roller and adjustment mechanism for adjusting the tension of the conveyor belt shown in a tightened position.
Figure 10:
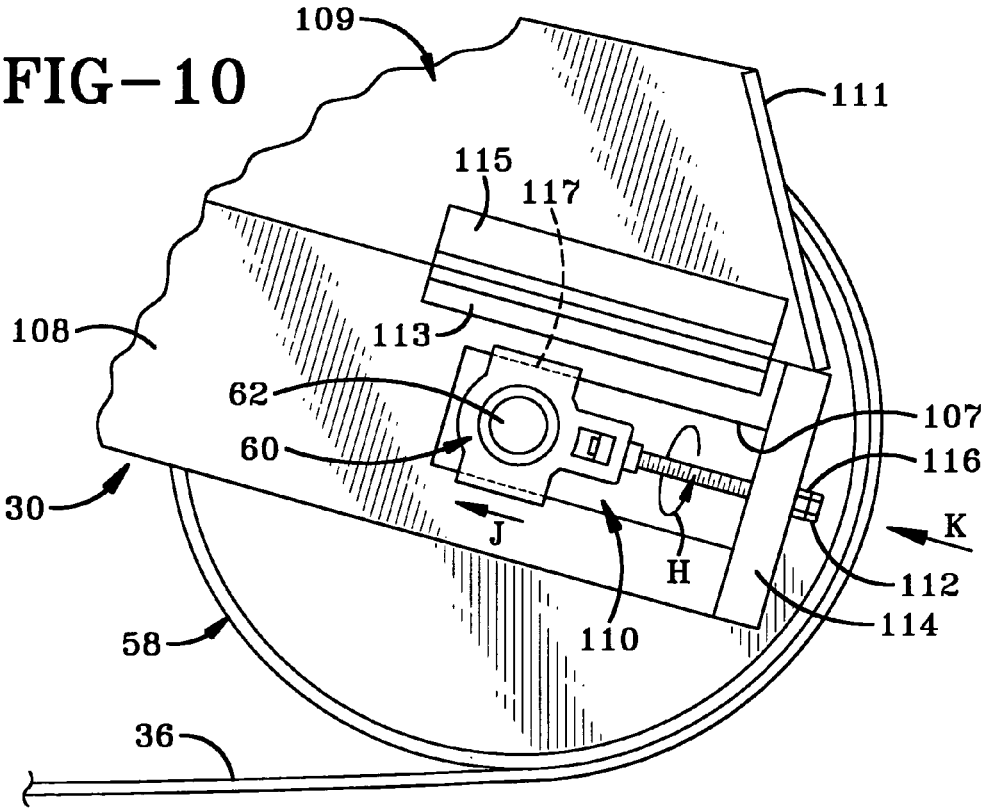
FIG. 10 is similar to FIG. 8 except showing the adjustment mechanism adjusted so that the conveyor belt is in a loosened position.

With reference to FIGS. 8-10, the loosening of conveyor belt 36 via adjustment mechanism 110 is described. FIG. 8 shows bolt 112 threadedly adjusted to a position whereby mounting bearing 60 is positioned away from second end 42 of conveyor belt assembly 30 and toward transverse member 114 in order to maintain conveyor belt 36 in the tightened position also shown in FIGS. 5-7.

With reference to FIG. 10, bolt 112 is rotated as indicated by Arrow H whereby bolt 112 moves mounting bearing 60 in the direction of Arrow J whereby first roller 58 is moved in the direction of Arrow K. Thus, mounting bearing 60 and first roller 58 have moved toward second end 42 of carrier assembly 30. With reference to FIG. 9, the movement of mounting bearing 60 occurs by sliding via the slidable tongue-in-groove engagement between support plate 108 and channels 117.

Figure 11:
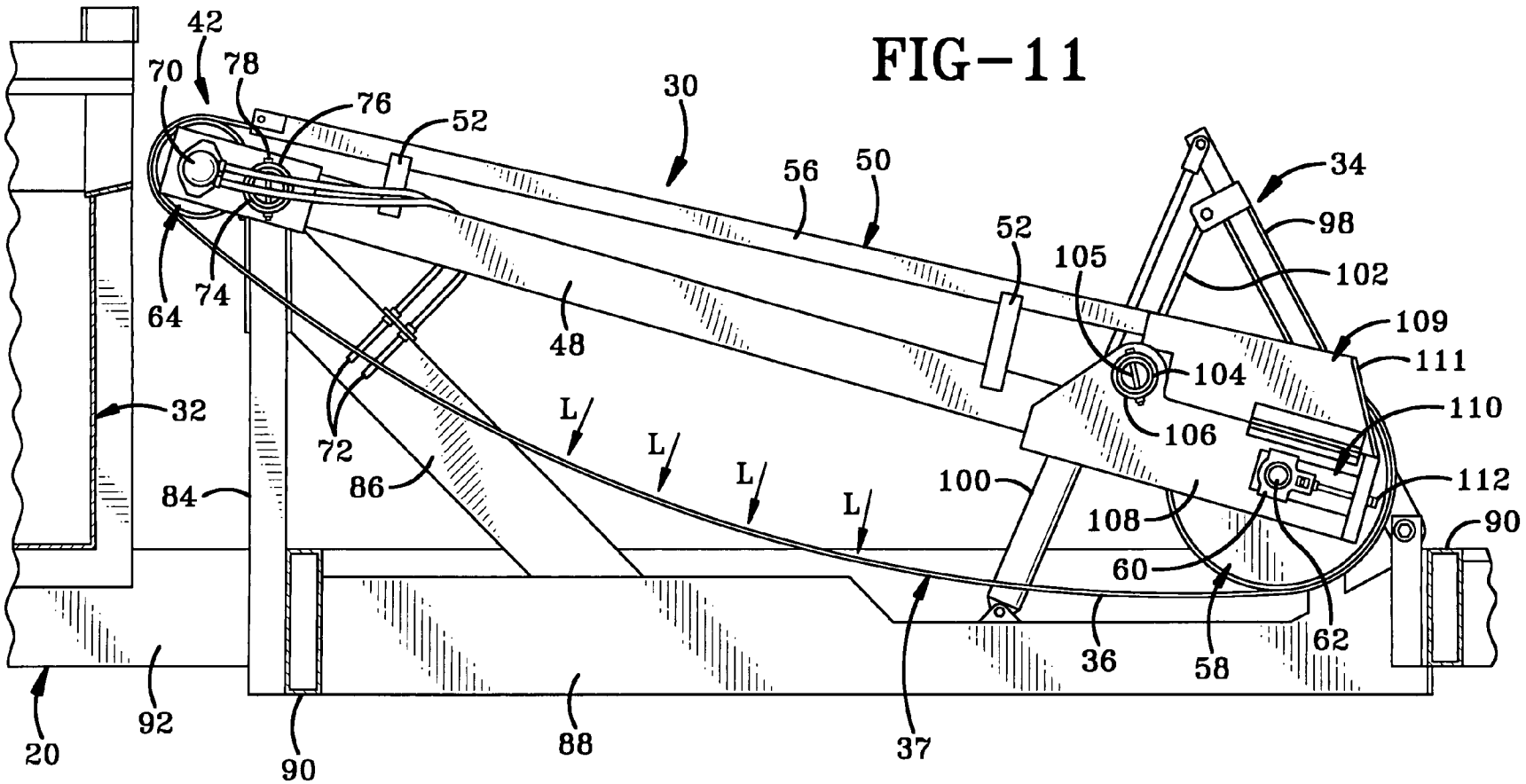
FIG. 11 is similar to FIG. 7 except showing the conveyor belt in the loosened position.

FIG. 11 shows adjustment mechanism 110 in the loosened position and as a result conveyor belt 36 has also been loosened as the lower portion of belt 36 has sagged in the direction of Arrows L. Loosening the tension on conveyor belt 36 has provided enough slack in belt 36 in order for belt 36 to clear guide wall 56 and guide plate 109 on second side 46 of conveyor belt assembly 30, that is, the side of assembly 30 away from lift 34. At this point, each conveyor belt 36 is removed from its respective conveyor belt assembly 30 while maintaining continuity of each belt 36, as indicated by Arrows M in FIG. 12. Subsequently, new belts 36 are installed while maintaining continuity of each belt 36, as indicated by Arrows N in FIG. 13.

Figure 14:
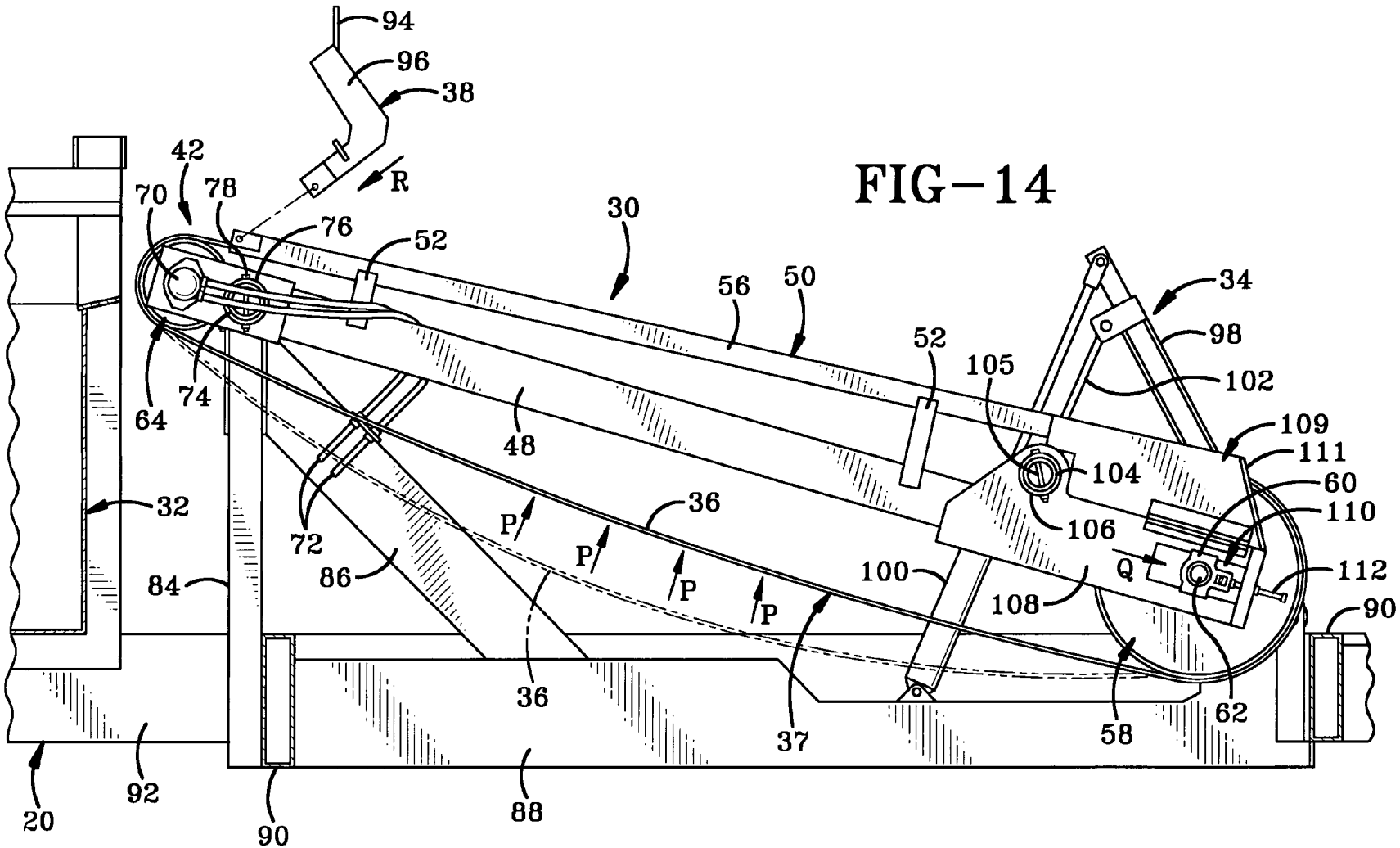
FIG. 14 is similar to FIG. 11 except showing the adjustment mechanism having been adjusted to move the conveyor belt to the tightened positioned from the loosened position shown in phantom and the ramp assembly in the process of being reinstalled.
Figure 15:
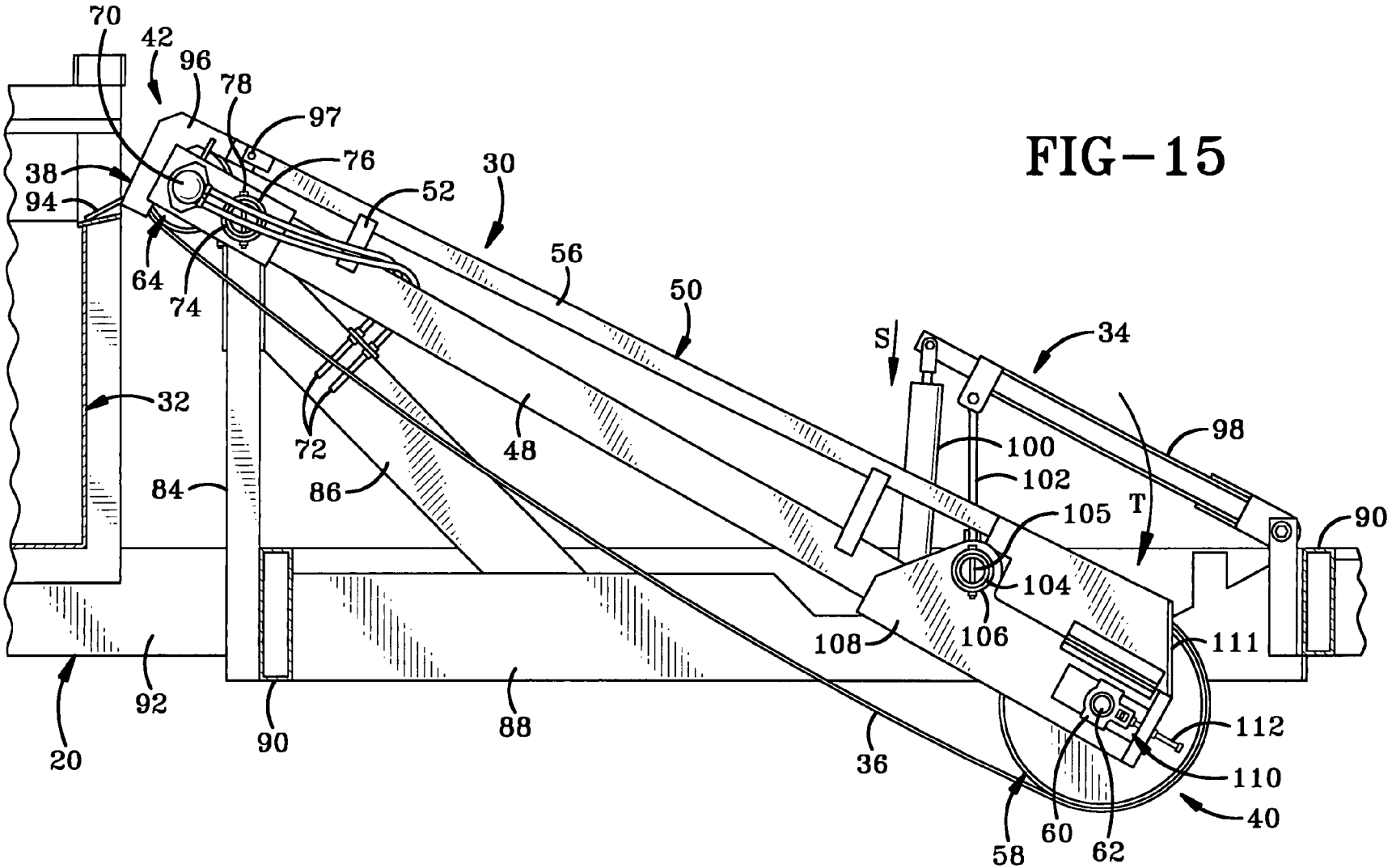
FIG. 15 is similar to FIG. 14 except showing the ramp assembly reinstalled and the conveyor belt assembly having moved to the lowered operational position.

Continuing the reversal of the removal procedure, FIG. 14 shows the installed conveyor belt 36 being tightened in the direction indicated by Arrows P as adjustment mechanism 110 is adjusted to move mounting bearing 60 and first roller 58 in the direction indicated by Arrow Q. FIG. 14 also shows ramp assembly 38 in the process of being reinstalled as indicated by Arrow R. Finally, FIG. 15 shows piston-cylinder combination 100 being retracted in the direction of Arrow S so that lift 34 is lowered along with second end 42 of conveyor belt assembly 30 which has rotated about pivot tubes 74 and 104 as indicated by Arrow T. Thus, FIG. 15 shows conveyor belt assembly 30 in the operational position once again.

In accordance with another feature of the invention, and with reference to FIGS. 5, 6, 16 and 17, ramp assembly 38 is rotatably movable between an operational position wherein ramp 94 rests on a wall of hopper 32 (FIG. 5) and a non-operational or hopper-emptying position wherein assembly 38 is moved away from hopper 32 (FIG. 6). More particularly, as previously described, ramp assembly 38 is rotatably mounted on conveyor belt assembly 30. In the operational position, ramp assembly 38 is situated to guide metallic objects such as railroad spikes 14 from conveyor belt 36 into hopper 32. In the non-operational position, assembly 38 is situated to allow hopper 32 to move for emptying the metallic objects therefrom without interference from assembly 38.

Figure 16:
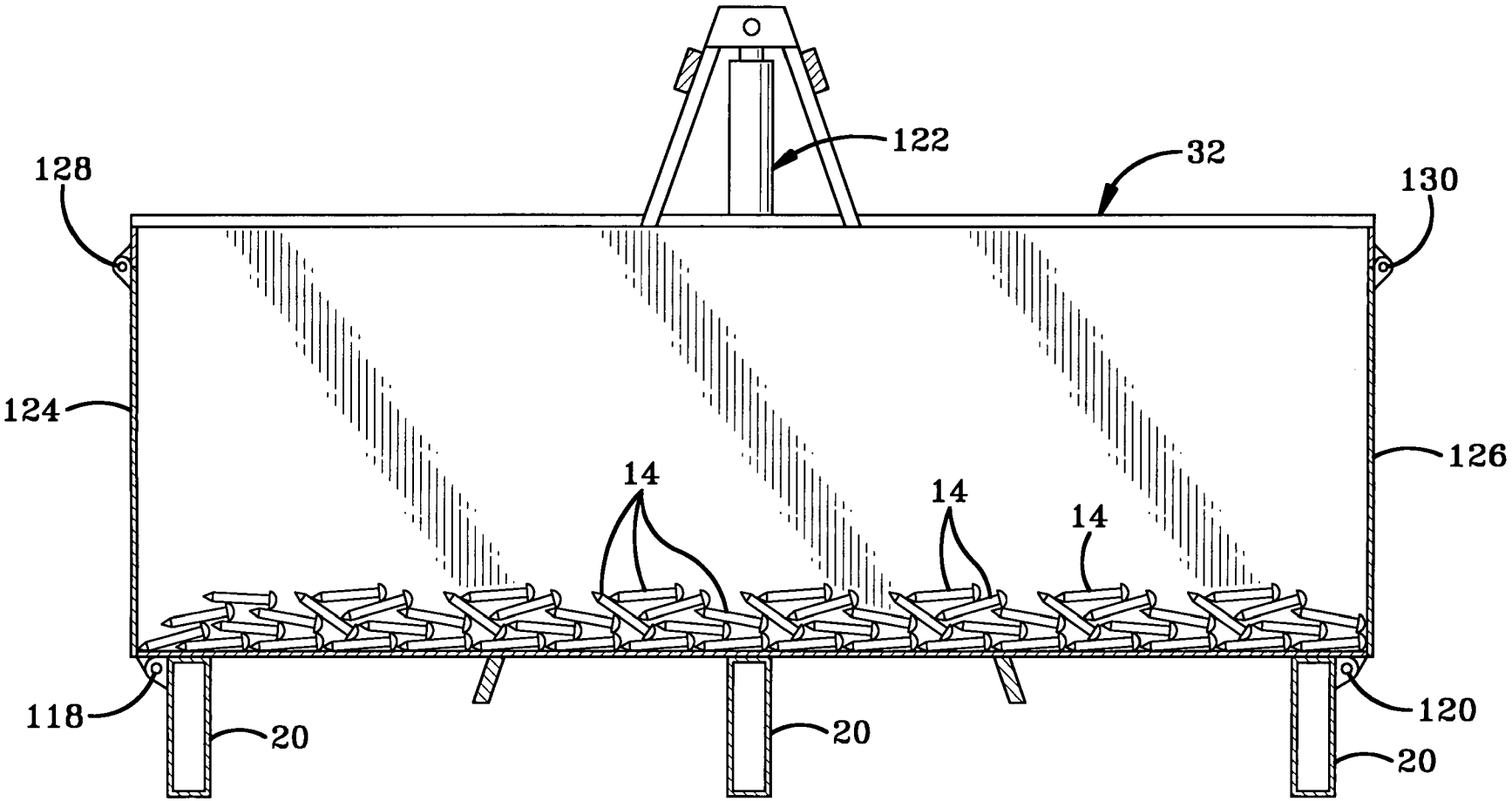
FIG. 16 is a sectional view of the hopper, one of the hopper lifts and a portion of the retriever frame with the hopper in an operational position with railroad spikes therein.
Figure 17:
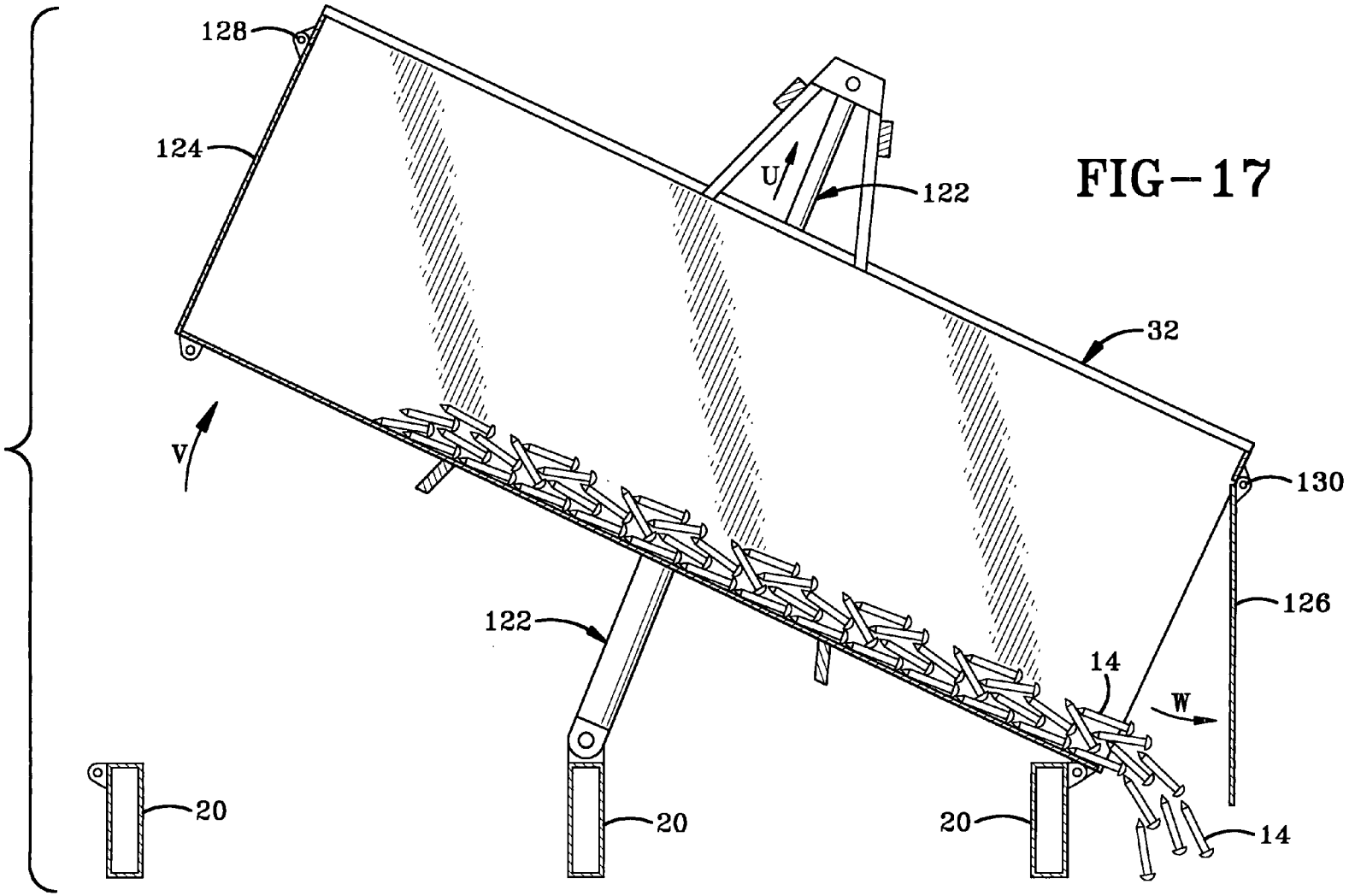
FIG. 17 is similar to FIG. 16 and shows the hopper being tilted to one side by the lifts to empty the railroad spikes from the hopper.

FIGS. 16 and 17 illustrate the emptying of hopper 32. Hopper 32 is rotatably mounted to frame 20 of retriever 10 by a first removable pivot 118 on one end of hopper 32 and a second removable pivot 120 on the other end of hopper 32. A pair of lifts 122 is disposed respectively on each side of hopper 32 and mounted on frame 20 of retriever 10 (FIG. 1 shows both lifts 122). Hopper 32 includes a first end door 124 on one end thereof and a second end door 126 on the other end thereof. First door 124 is pivotally mounted via a pivot 128 and second door 126 is pivotally mounted via a pivot 130.

To empty hopper 32, pivot 118 is first removed. Then, lifts 122 are operated to extend each lift 122 as shown by arrow U in FIG. 17 to rotate hopper 32 in the direction indicated by arrow V about pivot 120. The lifting and rotation of hopper 32 allows door 126 to pivot open about pivot 130 as indicated by arrow W in FIG. 17, whereby spikes 14 are emptied from hopper 32. Hopper 32 is configured to dump to either side and thus pivot 120 may be removed to allow hopper 32 to pivot about pivot 118 so that door 124 opens and spikes empty out through the other end of hopper 32 in the same manner as described above. The configuration of conveyor belt assembly 30 and ramp assembly 38 thus provides an effective transition ramp for spikes 14 from conveyor belt 36 to hopper 32 (FIG. 5) while allowing sufficient spacing between second end 42 of assembly 30 and hopper 32 when ramp assembly 38 is raised (FIG. 6) to allow the rotational movement of hopper 32 to dump spikes 14 (FIG. 17).

The rotational mounting of ramp assembly 38 also provides another advantage. In particular, it allows ramp assembly 38 to rotate so that ramp 94 remains in a resting position on the wall of hopper 32 as conveyor belt assembly 30 rotates about pivot tube 74 during lifting and lowering of first end 40 of assembly 30. This prevents an interference between ramp assembly 38 and hopper 32 and damage that would otherwise occur with a fixed ramp assembly.

Thus, retriever 10 provides an apparatus which greatly simplifies and expedites the removal and replacement of conveyor belts on such a retriever. It will be appreciated that a great number of variations may be made without departing from the spirit of the invention. For example, ramp assembly 38 is not a requirement in order for the functioning of removal and installation of conveyor belt 36. However, as described above, ramp assembly 38 provides an effective guide for railroad spikes 14 in their transition from conveyor belt 36 into hopper 32 and has advantages previously noted. Alternatively, a ramp may be mounted on the wall of hopper 32 adjacent second end 42 of conveyor belt assembly 30 in order to accomplish the transition of the metallic objects from the conveyor belt to the hopper. Further, the wall of hopper 32 adjacent the conveyor belt could be angled to act as a ramp. A ramp may be eliminated altogether as long as conveyor belt 36 and hopper 32 are positioned relative to one another to allow the transfer of the metallic objects into hopper 32. However, positioning the conveyor belt assembly to effectively move metallic objects into the hopper without using a ramp may lead to the conveyor belt assembly interfering with the emptying of the hopper. Such an option would not be viable and is overcome by ramp assembly 38 of the present invention.

In addition, a lift such as lift 34 is not required in order for the conveyor belts to be removed and installed although the raising of first end 40 of conveyor belt assembly 30 facilities the removal by making conveyor belt 30 more accessible, especially from the outboard position. To facilitate this outboard accessibility, retriever 10 may be configured so that the lift raises first roller 58 completely above side rail 92, thus allowing the outboard conveyor belts to be removed in a horizontal direction without manipulation of the outboard belts in a vertical direction for the purpose of clearing side rail 92. The lift used to raise conveyor belt assembly 30 may take a variety of forms and may be powered by any suitable power source. However, it is important that any such lift be positioned between a pair of conveyor belt assemblies or to one side only of each given conveyor belt assembly so that it does not interfere with removal of the conveyor belt from the other side of the conveyor belt assembly.

In addition, any suitable motor may replace hydraulic motor 70 to drive second roller 64 and conveyor belt 36 in turn. Where a hydraulic motor is used, it is important that the hydraulic lines connected to the motor are threaded through the conveyor belt so that they do not interfere with the removal of the conveyor belt from the conveyor belt assembly. Where the motor is electric, this would be true of electrical wires as well and likewise for pneumatic lines running to a pneumatic motor and so forth. In addition, although it may be possible to install a motor between the pair of conveyor belt assemblies making up one of the sets thereof, this may be practically difficult due to the spacing therebetween which is defined by the dimensions of the railway track. Further, while such a motor may be disposed between a pair of conveyor belt assemblies to drive both assemblies with a single motor, there are advantages to having an individual motor for each conveyor belt assembly, such as making it easier to provide sufficient torque to each respective roller as well as providing a redundancy factor whereby if one motor fails the other assembly continues to operate. Maintenance access is also easier in this configuration.

The exemplary embodiment of the present invention uses pivot tubes about which the carrier assembly is rotatable adjacent either end thereof. However, any suitable pivot may be used in order to provide this function. It is noted that the upper pivot, that is pivot tube 74, is the primary location about which the conveyor belt assembly needs to rotate to move between the raised and lowered position. While a lower pivot, that is, pivot tube 104, is also provided, rotation about this pivot tube is not required.

In addition, the adjustment mechanism for adjusting the tension of the conveyor belt can take on a number of forms. For instance, it is not necessary that the mounting bearing used in the exemplary embodiment be the member that slides or otherwise moves in order to adjust the tension. For instance, frame member 48 may be made of a plurality of parts which slide or otherwise adjust with respect to one another in order to adjust carrier belt tension. Further, adjustment by a sliding movement is not necessary. This could be accomplished, for example, by a track having gears thereon allowing the mounting bearing or other structure to move to provide such adjustment. Such a gear track, for example, may also eliminate the use of a threaded bolt such as bolt 112 in making this type of adjustment. In addition, it is contemplated that the distance between the two ends of the carrier belt assembly need not be adjustable in order to adjust the tension of the belt. For example, a tensioner wheel or the like may be, for example, pressed against the lower portion of the belt in order to tighten the belt and then moved away from the belt in order to create sufficient slack in order to remove the belt. The exemplary embodiment, however, provides a simple and cost efficient apparatus for providing the adjustment mechanism.

Further, a hopper similar to hopper 32 may empty to only one side, and thus have only one end door, thus eliminating one of pivots 118 and 120 along with the corresponding door pivot. Hopper 32 may also be emptied by other methods, which may include, for instance, lifting of the entire hopper or rolling the hopper on rollers. However, the weight of hopper 32 when loaded with railroad spikes and/or other metallic objects is quite substantial so that cost, convenience and/or safety factors may make certain methods prohibitive or less feasible.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus for removing metallic objects from a railway bed having railroad tracks, the apparatus comprising:

a car adapted to travel on the railroad tracks;

a container mounted on the car;

at least one conveyor belt forming a closed loop; the at least one conveyor belt adapted to transport the metallic objects from adjacent the railway bed to the container;

at least one conveyor belt assembly on which the at least one conveyor belt is revolvably mounted; the at least one conveyor belt assembly having first and second opposed ends and first and second opposed sides each extending between the first and second ends; and a lift for moving the first end of the at least one conveyor belt assembly between a raised position and a lowered position adjacent the railway bed; the lift being disposed on the first side of the at least one conveyor belt assembly whereby the lift does not interfere with removal of the at least one conveyor belt from the second side of the at least one conveyor belt assembly; the at least one conveyor belt being removable while maintaining continuity of the at least one conveyor belt loop.

2. The apparatus of claim 1 further including a pivot about which the at least one conveyor belt assembly rotates as the first end of the at least one assembly moves between the raised and lowered positions; the pivot being disposed within the at least one conveyor belt loop whereby the pivot does not interfere with removal of the at least one conveyor belt from the second side of the at least one conveyor belt assembly.

3. The apparatus of claim 2 wherein the pivot is adjacent the second end of the at least one conveyor belt assembly.

4. The apparatus of claim 2 wherein the at least one conveyor belt has upper and lower portions between which the pivot is disposed.

5. The apparatus of claim 2 wherein the car includes a support disposed on the first side of the at least one conveyor belt assembly; wherein the pivot is mounted on the support in a cantilever fashion so that the apparatus is free of supporting structure for supporting the pivot on the second side of the at least one conveyor belt assembly.

6. The apparatus of claim 1 further including a motor adapted to revolvingly drive the at least one conveyor belt on the at least one conveyor assembly; the motor being in communication with power connections which are configured to power the motor and which pass within the loop of the at least one conveyor belt to prevent interference with removal of the at least one conveyor belt from the second side of the at least one conveyor belt assembly.

7. The apparatus of claim 6 wherein the at least one conveyor belt has upper and lower portions between which the power connections pass.

8. The apparatus of claim 1 further including a ramp disposed between the at least one conveyor belt and the container to guide the metallic objects from the at least one conveyor belt into the container; the ramp being removably mounted to the at least one conveyor belt assembly to permit the at least one conveyor belt to be removed when the ramp is removed.

9. The apparatus of claim 1 wherein a ramp is mounted on the at least one conveyor belt assembly and movable between a first position for guiding the metallic objects from the at least one conveyor belt into the container and a second position which does not interfere with movement of the container for the purpose of emptying the metallic objects therefrom.

10. The apparatus of claim 9 wherein the ramp is rotatably mounted on the at least one conveyor belt assembly.

11. The apparatus of claim 9 wherein the container is rotatably mounted on the car to rotate between a first position for receiving the metallic objects from the at least one conveyor belt via the ramp and a second position for emptying the metallic objects therefrom.

12. The apparatus of claim 1 wherein the at least one conveyor belt has a tension adjustable between an operational mode and a replacement mode to facilitate removal of the at least one conveyor belt.

13. The apparatus of claim 1 wherein the lift includes a support arm rotatably mounted on the car about a first pivot and a lift mechanism mounted on the car for raising and lowering the support arm; wherein the lift mechanism includes an extendable-retractable actuator which is pivotally connected to the car about a second pivot and pivotally connected to the support arm about a third pivot; and wherein the at least one conveyor belt assembly adjacent its first end is suspended from the support arm.

14. The apparatus of claim 13 wherein the at least one conveyor belt assembly is suspended from the support arm via a suspension member mounted on the support arm and on a pivot on which the at least one conveyor belt assembly is rotatably mounted; and wherein the suspension member hangs downwardly from the support arm.

15. The apparatus of claim 13 wherein the lift mechanism is hydraulically powered.

16. The apparatus of claim 1 wherein the car has front and rear ends and a pair of opposed sides each extending between the front and rear ends; and wherein the second side of the at least one conveyor belt assembly is adjacent one of the sides of the car.

17. The apparatus of claim 1 wherein the at least one conveyor belt includes first and second conveyor belts; wherein the at least one conveyor belt assembly includes first and second conveyor belt assemblies on which the first and second conveyor belts are respectively revolvably mounted; and wherein the lift is disposed between the first and second conveyor belt assemblies.

18. The apparatus of claim 17 wherein the car has front and rear ends and a pair of opposed sides each extending between the front and rear ends; wherein the first and second conveyor belt assemblies are respectively inboard and outboard assemblies forming a first set; wherein there is a second such set and another lift disposed between the respective inboard and outboard conveyor belt assemblies of the second set; and wherein the second sides of the outboard assemblies are adjacent respective sides of the car and the second sides of the inboard assemblies face one another.

19. The apparatus of claim 1 wherein the car has first and second opposed sides; wherein the container is pivotally mounted on the car to pivot toward the first side and alternately to pivot toward the second side for emptying the metallic objects therefrom respectively on the first side of the car and the second side of the car.

20. The apparatus of claim 1 wherein the container is pivotally mounted on the car about a pivot; wherein the container defines a top entrance opening for receiving the metallic objects from the at least one conveyor belt; wherein the container defines a side opening; wherein the container includes a door which covers the side opening in a closed position and pivots outwardly to an open position for emptying the metallic objects through the side opening when the container is tilted about the pivot in the direction of the door.

21. An apparatus for removing metallic objects from a railway bed having railroad tracks, the apparatus comprising:

a car adapted to travel on the railroad tracks;

a container mounted on the car;

at least one conveyor belt forming a closed loop and being adapted to transport the metallic objects from adjacent the railway bed to the container;

at least one conveyor belt assembly on which the at least one conveyor belt is revolvably mounted; and a motor for revolvingly driving the at least one conveyor belt on the at least one conveyor belt assembly; the motor being in communication with power connections which are configured for powering the motor and which pass within the loop of the at least one conveyor belt to prevent interference with removal of the at least one conveyor belt from the at least one assembly; the at least one conveyor belt being removable while maintaining continuity of the at least one conveyor belt loop.

22. The apparatus of claim 21 further including first and second rotatable rollers around which the at least one conveyor belt is revolvable; and wherein the motor is adapted to rotate one of the rollers to drive the revolution of the at least one conveyor belt around the first and second rollers.

23. The apparatus of claim 22 wherein the at least one conveyor belt assembly has first and second opposed ends about which the at least one conveyor belt is revolvable and first and second opposed sides each extending between the first and second ends; wherein the motor is disposed on the second side of the at least one conveyor belt assembly; and wherein the at least one conveyor belt is removable from the second side of the at least one conveyor belt assembly.

24. The apparatus of claim 21 further including a hydraulic pump; and wherein the motor is a hydraulic motor and the power connections are hydraulic lines in communication with the motor and the hydraulic pump.

25. The apparatus of claim 21 wherein the at least one conveyor belt has a tension adjustable between an operational mode and a replacement mode to facilitate removal of the at least one conveyor belt.

26. The apparatus of claim 21 wherein a ramp is disposed between the at least one conveyor belt and the container to guide the metallic objects from the at least one conveyor belt into the container; the ramp being removably mounted to the at least one conveyor belt assembly to permit the at least one conveyor belt to be removed when the ramp is removed.

27. The apparatus of claim 21 wherein a ramp is mounted on the at least one conveyor belt assembly and movable between a first position for guiding the metallic objects from the at least one conveyor belt into the container and a second position which does not interfere with movement of the container for the purpose of emptying the metallic objects therefrom.

28. The apparatus of claim 21 wherein the at least one conveyor belt has upper and lower portions between which the power connections pass.

29. The apparatus of claim 21 wherein the car has front and rear ends and a pair of opposed sides each extending between the front and rear ends; wherein the at least one conveyor belt assembly has first and second opposed ends and first and second opposed sides each extending between the first and second ends; wherein the motor is disposed on the second side of the at least one conveyor belt assembly; wherein the at least one conveyor belt is removable from the second side of the at least one conveyor belt assembly; and wherein the second side of the at least one conveyor belt assembly is adjacent one of the sides of the car.

30. The apparatus of claim 21 wherein the at least one conveyor belt includes first and second conveyor belts; wherein the at least one conveyor belt assembly includes first and second conveyor belt assemblies on which the first and second conveyor belts are respectively revolvably mounted; wherein each conveyor belt assembly has first and second opposed ends and first and second opposed sides each extending between the first and second ends; wherein the respective first sides of the first and second assemblies face one another; wherein each conveyor belt is removable from the second side of the respective assembly; wherein the motor is for revolvingly driving the first conveyor belt and is disposed on the second side of the first assembly; and wherein another motor for revolvingly driving the second conveyor belt is disposed on the second side of the second assembly.

31. The apparatus of claim 30 wherein the car has front and rear ends and a pair of opposed sides each extending between the front and rear ends; wherein the first and second conveyor belt assemblies are respectively inboard and outboard assemblies forming a first set; wherein there is a second such set with a pair of motors arranged in the same manner as with the first set; and wherein the second sides of the outboard assemblies are adjacent respective sides of the car and the second sides of the inboard assemblies face one another.

32. The apparatus of claim 21 wherein the power connections include one of a hydraulic line, an electrical wire and a pneumatic line.

33. The apparatus of claim 21 wherein the at least one conveyor belt assembly includes first and second rotatable rollers around which the at least one conveyor belt is revolvably mounted; and wherein the power connections pass between the first and second rollers within the loop of the at least one conveyor belt.

* * * * *

UNITED STATES PATENT AND TRADEMARK OFFICE

CERTIFICATE OF CORRECTION

PATENT NO. : 7,244,089 B2
APPLICATION NO. : 10/889920
DATED : July 17, 2007
INVENTOR(S) : Sperling It is certified that error appears in the above-identified patent and that said Letters Patent is hereby corrected as shown below:

Column 10, line 31 add --from the second side of the at least one conveyor belt assembly-- after "removable the at least one conveyor belt being removable" from the second side of the at least one conveyor belt assembly while maintaining continuity of the at least one conveyor belt loop.

Column 12, line 28 add --from the at least one conveyor belt assembly-- after "removable least one conveyor belt being removable" from the at least one conveyor belt assembly while maintaining continuity of the at least one conveyor belt assembly while maintaining continuity of the at least one conveyor belt loop.

Column 12, line 43 add --while maintaining continuity of the at least one conveyor belt loop-- after "assembly second side of the at least one conveyor belt assembly while maintaining continuity of the at least one conveyor belt loop;

Column 13, line 9 add --while maintaining continuity of the at least one conveyor belt loop-- after "assembly second side of the at least one conveyor belt assembly" while maintaining continuity of the at least one conveyor belt loop;

Column 13, line 22 add --while maintaining continuity of the respective conveyor belt loops-- after "assembly from the second side of the respective assembly" while maintaining continuity of the respective conveyor belt loops.

Signed and Sealed this

Twenty-third Day of October, 2007

JON W. DUDAS
*Director of the United States Patent and Trademark Office*